US008697992B2

(12) United States Patent
Gillan et al.

(10) Patent No.: US 8,697,992 B2
(45) Date of Patent: Apr. 15, 2014

(54) EXTENDED LENGTH CABLE ASSEMBLY FOR A HYDROCARBON WELL APPLICATION

(75) Inventors: Peter Gillan, Denend (GB); Joseph Varkey, Sugar Land, TX (US); Jose Ramon Lozano-Gendreau, Stafford, TX (US); Vladimir Hernandez-Solis, Stafford, TX (US); Jan W. Smits, Clamart (FR); Hifzi Ardic, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 851 days.

(21) Appl. No.: 12/356,599

(22) Filed: Jan. 21, 2009

(65) Prior Publication Data

US 2009/0194296 A1 Aug. 6, 2009

Related U.S. Application Data

(63) Continuation-in-part of application No. 11/813,755, filed on Mar. 13, 2008, now Pat. No. 7,586,042.

(60) Provisional application No. 61/063,231, filed on Feb. 1, 2008.

(51) Int. Cl.

| | |
|---|---|
| ***H02G 3/04*** | (2006.01) |
| ***H02G 15/013*** | (2006.01) |
| ***H02G 15/08*** | (2006.01) |
| ***H01B 7/18*** | (2006.01) |
| ***H01B 7/00*** | (2006.01) |

(52) U.S. Cl.

USPC ..... 174/68.1; 174/74 R; 174/75 R; 174/79; 174/84 R; 174/102 R; 174/113 R

(58) Field of Classification Search

USPC ..... 174/74 R, 75 R, 77 R, 78, 79, 84 R, 88 R, 174/88 C, 88 S, 90, 102 R, 85 R, 86, 108, 174/68.1, 113 R; 166/385, 66, 67, 187

See application file for complete search history.

(56) References Cited

U.S. PATENT DOCUMENTS

| | | | |
|---|---|---|---|
| 1,948,439 | A | 2/1934 | Budscheid |
| 2,576,227 | A | 11/1951 | Hutchins, Jr. |

(Continued)

FOREIGN PATENT DOCUMENTS

| | | | |
|---|---|---|---|
| BR | PI0900142 | A2 | 9/2009 |
| EP | 0003104 | A1 | 7/1979 |

(Continued)

OTHER PUBLICATIONS

English Translation of RU 2087929. Korzhenevskiy A.G., et al., Geophysical Cable for Studying Inclined and Horizontal Boreholes and Methods of Using It, Aug. 1997.*

(Continued)

*Primary Examiner* — Timothy Thompson
*Assistant Examiner* — Sherman Ng
(74) *Attorney, Agent, or Firm* — Trevor Grove; John Vereb

(57) ABSTRACT

A cable assembly for use in a hydrocarbon well of extensive depth. The cable assembly may be effectively employed at well depths of over 30,000 feet. Indeed, embodiments of the assembly may be effectively employed at depths of over 50,000 feet while powering and directing downhole equipment at a downhole end thereof. The assembly may be made up of a comparatively high break strength uphole cable portion coupled to a lighter downhole cable portion. This configuration helps to ensure the structural integrity of the assembly in light of its own load when disposed in a well to such extensive depths. Additionally, the assembly may be employed at such depths with an intervening connector sub having a signal amplification mechanism incorporated therein to alleviate concern over telemetry between the surface of the oilfield and the downhole equipment.

23 Claims, 6 Drawing Sheets

(56) References Cited

U.S. PATENT DOCUMENTS

| | | | | |
|---|---|---|---|---|
| 2,604,509 | A | 7/1952 | Blanchard | |
| 3,115,542 | A | 12/1963 | Palandri et al. | |
| 3,127,083 | A | 3/1964 | Guyer | |
| 3,217,083 | A | 11/1965 | Gore | |
| 3,313,346 | A | 4/1967 | Cross | |
| 3,328,140 | A | 6/1967 | Warren | |
| 3,346,045 | A | 10/1967 | Knapp et al. | |
| 3,482,034 | A | 12/1969 | Rhoades et al. | |
| 3,490,125 | A | 1/1970 | Frieling, Jr. | |
| 3,634,607 | A * | 1/1972 | Coleman | 174/120 R |
| 3,679,812 | A * | 7/1972 | Owens | 174/108 |
| 3,681,514 | A | 8/1972 | Rhoades et al. | |
| 3,710,859 | A | 1/1973 | Hanes et al. | |
| 3,758,704 | A | 9/1973 | Naud | |
| 3,766,307 | A | 10/1973 | Andrews, Jr. | |
| 3,921,061 | A | 11/1975 | Miller | |
| 4,016,942 | A * | 4/1977 | Wallis et al. | 175/45 |
| 4,059,951 | A | 11/1977 | Roe | |
| 4,077,022 | A * | 2/1978 | Pitts, Jr. | 333/1 |
| 4,131,757 | A | 12/1978 | Felkel | |
| 4,131,758 | A | 12/1978 | Felkel | |
| 4,197,423 | A | 4/1980 | Fusen | |
| 4,250,351 | A | 2/1981 | Bridges | |
| 4,281,716 | A | 8/1981 | Hall | |
| 4,292,588 | A * | 9/1981 | Smith | 324/221 |
| 4,409,431 | A | 10/1983 | Neuroth | |
| 4,486,252 | A | 12/1984 | Lloyd | |
| 4,522,464 | A | 6/1985 | Thompson et al. | |
| 4,523,804 | A | 6/1985 | Thompson | |
| 4,525,813 | A | 6/1985 | Burrage | |
| 4,577,693 | A | 3/1986 | Graser | |
| 4,606,604 | A | 8/1986 | Soodak | |
| 4,644,094 | A | 2/1987 | Hoffman | |
| 4,645,298 | A | 2/1987 | Gartside, III | |
| 4,675,474 | A | 6/1987 | Neuroth | |
| 4,679,041 | A | 7/1987 | Fetter et al. | |
| 4,722,589 | A | 2/1988 | Priaroggia | |
| 4,743,711 | A | 5/1988 | Hoffman | |
| 4,762,180 | A | 8/1988 | Wybro et al. | |
| 4,768,984 | A | 9/1988 | de Oliveira et al. | |
| 4,825,953 | A | 5/1989 | Wong et al. | |
| 4,830,113 | A * | 5/1989 | Geyer | 166/369 |
| 4,899,823 | A | 2/1990 | Cobb et al. | |
| 4,952,012 | A | 8/1990 | Stamnitz | |
| 4,979,795 | A | 12/1990 | Mascarenhas | |
| 4,986,360 | A | 1/1991 | Laky et al. | |
| 4,993,492 | A | 2/1991 | Cressey et al. | |
| 5,002,130 | A | 3/1991 | Laky | |
| 5,088,559 | A | 2/1992 | Taliaferro | |
| 5,125,061 | A | 6/1992 | Marlier et al. | |
| 5,125,062 | A | 6/1992 | Marlier et al. | |
| 5,150,443 | A | 9/1992 | Wijnberg | |
| 5,329,605 | A | 7/1994 | Wargotz | |
| 5,431,759 | A | 7/1995 | Neuroth | |
| 5,495,547 | A * | 2/1996 | Rafie et al. | 385/101 |
| 5,778,981 | A | 7/1998 | Head | |
| 5,787,217 | A | 7/1998 | Traut et al. | |
| 5,857,523 | A | 1/1999 | Edwards | |
| 5,894,104 | A | 4/1999 | Hedberg | |
| 6,015,013 | A | 1/2000 | Edwards et al. | |
| 6,030,255 | A | 2/2000 | Konishi et al. | |
| 6,053,252 | A | 4/2000 | Edwards | |
| 6,060,662 | A | 5/2000 | Rafie et al. | |
| 6,116,345 | A | 9/2000 | Fontana et al. | |
| 6,161,619 | A | 12/2000 | Head | |
| 6,182,765 | B1 | 2/2001 | Kilgore | |
| 6,195,487 | B1 | 2/2001 | Anderson et al. | |
| 6,211,467 | B1 | 4/2001 | Berelsman et al. | |
| 6,276,456 | B1 | 8/2001 | Head | |
| 6,386,290 | B1 | 5/2002 | Headworth | |
| 6,403,889 | B1 | 6/2002 | Mehan et al. | |
| 6,442,304 | B1 * | 8/2002 | Crawley et al. | 385/12 |
| 6,484,806 | B2 | 11/2002 | Childers et al. | |
| 6,488,093 | B2 | 12/2002 | Moss | |
| 6,555,752 | B2 | 4/2003 | Dalrymple et al. | |
| 6,559,383 | B1 * | 5/2003 | Martin | 174/84 R |
| 6,559,385 | B1 | 5/2003 | Johnson et al. | |
| 6,600,108 | B1 | 7/2003 | Mydur et al. | |
| 6,631,095 | B1 | 10/2003 | Bryant et al. | |
| 6,659,180 | B2 | 12/2003 | Moss | |
| 6,675,888 | B2 | 1/2004 | Schempf et al. | |
| 6,691,775 | B2 | 2/2004 | Headworth | |
| 6,745,840 | B2 | 6/2004 | Headworth | |
| 6,747,213 | B2 | 6/2004 | Bonicel | |
| 6,763,889 | B2 | 7/2004 | Rytlewski et al. | |
| 6,776,195 | B2 | 8/2004 | Blasko et al. | |
| 6,807,988 | B2 | 10/2004 | Powell et al. | |
| 6,834,724 | B2 | 12/2004 | Headworth | |
| 6,843,321 | B2 | 1/2005 | Carlsen | |
| 6,919,512 | B2 * | 7/2005 | Guven et al. | 174/84 R |
| 7,000,903 | B2 | 2/2006 | Piecyk et al. | |
| 7,116,283 | B2 | 10/2006 | Benson et al. | |
| 7,139,218 | B2 * | 11/2006 | Hall et al. | 367/82 |
| 7,170,007 | B2 | 1/2007 | Varkey et al. | |
| 7,188,406 | B2 | 3/2007 | Varkey et al. | |
| 7,282,644 | B1 * | 10/2007 | Alvey | 174/84 R |
| 7,402,753 | B2 | 7/2008 | Varkey et al. | |
| 7,523,804 | B2 | 4/2009 | Tanaka et al. | |
| 7,586,042 | B2 | 9/2009 | Varkey et al. | |
| 7,700,880 | B2 | 4/2010 | Varkey et al. | |
| 7,719,283 | B2 | 5/2010 | Ishikawa et al. | |
| 7,798,234 | B2 | 9/2010 | Ju et al. | |
| 8,227,697 | B2 | 7/2012 | Varkey et al. | |
| 2003/0011489 | A1 * | 1/2003 | Viswanathan | 340/853.1 |
| 2003/0169179 | A1 * | 9/2003 | James, II | 340/854.9 |
| 2004/0163822 | A1 * | 8/2004 | Zhang et al. | 166/380 |
| 2004/0262027 | A1 | 12/2004 | Kaczmarski | |
| 2005/0217844 | A1 | 10/2005 | Edwards et al. | |
| 2005/0219063 | A1 | 10/2005 | Viswanathan et al. | |
| 2006/0187084 | A1 * | 8/2006 | Hernandez-Marti et al. | 340/854.9 |
| 2006/0221768 | A1 * | 10/2006 | Hall et al. | 367/82 |
| 2007/0003780 | A1 * | 1/2007 | Varkey et al. | 428/586 |
| 2007/0158095 | A1 * | 7/2007 | Sridhar et al. | 174/106 R |
| 2008/0083533 | A1 * | 4/2008 | Malone et al. | 166/254.2 |
| 2009/0145610 | A1 | 6/2009 | Varkey et al. | |

FOREIGN PATENT DOCUMENTS

| | | | |
|---|---|---|---|
| EP | 0471600 | A1 | 2/1992 |
| EP | 1216342 | B1 | 6/2002 |
| EP | 2039878 | A1 | 3/2009 |
| FR | 2767861 | A1 | 3/1999 |
| GB | 2234722 | A | 2/1991 |
| JP | 54007186 | | 1/1979 |
| JP | 02216710 | | 8/1990 |
| NO | 20090471 | A | 8/2009 |
| RU | 2087929 | C1 * | 8/1997 |
| RU | 2105326 | C1 | 2/1998 |
| RU | 2138613 | C1 | 9/1999 |
| RU | 2138834 | C1 | 9/1999 |
| RU | 2209450 | C1 * | 7/2003 |
| SU | 781981 | A1 | 11/1980 |
| WO | 9948111 | | 9/1999 |
| WO | 02071178 | A2 | 9/2002 |
| WO | 2006003362 | A1 | 1/2006 |
| WO | 2006027553 | A1 | 3/2006 |
| WO | 2007034242 | A1 | 3/2007 |
| WO | 2006088372 | A1 | 8/2008 |

OTHER PUBLICATIONS

Machine (English) Translation of RU2209450 (C1): Khorzhenevskaya T A et al.; Load-Carrying Logging Cable (Variants) and Process of Investigation of Inclined and Horizontal Wells; Jul. 27, 2003.*

SM Lebedev, Os Gefle, Yu P Pokholkov and Vi Chichikin, "The Breakdown Strength of Two-Layer Dielectrics", High Voltage Engineering Symposium, Aug. 22-27, 1999, Tomsk Polytechnic University, Tomsk, Russia #4.304.P2.

(56) References Cited

OTHER PUBLICATIONS

MMA Salama, R Hackman, Fellow and AY Chikhani, Sr., "Instructional Design of Multi-Layer Insulation of Power Cables", Transaction on Power Systems, vol. 7, No. 1, Feb. 1992, pp. 377-382.

Russian Office Action for Russian Patent Application No. 2009103151 dated Sep. 11, 2012.

Decision on Grant Patent for Invention for Russian Application No. 200910315 dated Nov. 29, 2013.

* cited by examiner

EXTENDED LENGTH CABLE ASSEMBLY FOR A HYDROCARBON WELL APPLICATION

CROSS REFERENCE TO RELATED APPLICATION(S)

This Patent Document claims priority under 35 U.S.C. §119(e) to U.S. Provisional Application Ser. No. 61/063,231, entitled Multiple Cables Connected in Series by Means of a Connecting Sub, filed on Feb. 1, 2008, which is incorporated herein by reference in its entirety. This Patent Document is also a Continuation-In-Part claiming priority under 35 U.S.C. §120 to U.S. application Ser. No. 11/813,755 entitled Enhanced Electrical Cables, filed on Mar. 13, 2008, now U.S. Pat. No. 7,586,042, which was the PCT Natonal Stage application of International Patent Application No. PCT/IB2006/050119, which claims priority to application Ser. No. 11/033,698 entitled "Enhanced Electrical Cables" filed Jan. 12, 2005, Now U.S. Pat. No. 7,170,007, also incorporated herein by reference in its entirety.

FIELD

The statements in this section merely provide background information related to the present disclosure and may not constitute prior art.

Embodiments described relate to application cables for disposing in hydrocarbon wells. In particular, embodiments of extended length cables are described for use in deep wells, for example, exceeding about 30,000 feet in depth. Cables as described herein may be employed for communicating with, and positioning tools at, such extreme well depths. This may be achieved effectively and in a manner substantially avoiding cable damage during the application in spite of the extreme well depths involved.

BACKGROUND

The statements in this section merely provide background information related to the present disclosure and may not constitute prior art.

Exploring, drilling, completing, and operating hydrocarbon and other wells are generally complicated, time consuming, and ultimately very expensive endeavors. Thus, in order to maximize hydrocarbon recovery from underground reservoirs, hydrocarbon wells are becoming of increasingly greater depths and more sophisticated. For example, wells exceeding 25,000 feet in depth which are highly deviated are becoming increasingly common.

Furthermore, in recognition of the expenses involved in completing and operating such hydrocarbon wells, added emphasis has been placed on well access, monitoring and management throughout its productive life. Ready access to well information and intervention may play critical roles in maximizing the life of the well and total hydrocarbon recovery. As a result, downhole tools are frequently deployed within a given hydrocarbon well throughout its life. These tools may include logging tools to acquire data relative to well conditions, intervention tools to address downhole conditions, and even downhole conveyance mechanisms such as downhole tractors to aid in achieving access to downhole portions of the well which may otherwise be potentially inaccessible.

The above noted downhole tools may be delivered to a downhole location by way of a cable. Given the depth of the well, the cable is of a configuration intended to support its own load as well as that of a toolstring of various downhole equipment. Thus, with ever increasing well depths in use, the break strength of today's cables are also increasing. Unfortunately, however, there is a limit to the benefit available from increasing the cable strength. That is, as a practical matter, an increase in the break strength of the cable also increases its overall weight, thereby adding to the load imparted on the cable. Thus, significant increases in break strength may be self-defeating. As a result, cables exceeding about 30,000 feet or so for corresponding well depths are generally impractical.

In addition to physical delivery capabilities, the cable may be configured to provide power and communication between the tool and other equipment at the surface of the oilfield. Generally, this may be achieved over a copper core or other suitable power and telemetry structure as described below. Similar to the load bearing capacity of the cable as noted above, the cable is also configured in light of these telemetry requirements and downhole power needs, especially in light of the potentially extensive length of the cable into the well.

With respect to communication over the cable, a conventional core may display about 1 dB of signal loss per every thousand feet of cable. Nevertheless, telemetry between the equipment at the surface of the oilfield and the downhole tool may remain effective over a conventional cable up until about 30 dB of signal loss has occurred. Unfortunately, this means that telemetry between the surface equipment and the downhole tool is significantly compromised over a conventional cable that exceeds about 30,000 feet. Furthermore, in circumstances where communication involves the return of signal back to the surface equipment, the return signal is even weaker upon return over such an extensive cable. In theory, the effects of such signal loss may be combated by use of a lower gauge core, say less than about 15 gauge copper wire. Unfortunately, this leads to an increase in cable profile and, perhaps more significantly, adds to the overall weight of the cable, thus further compounding load issues as described above.

As indicated, power is often provided to the downhole tool over the cable as well. For example, where a downhole tractor is present, up to 2 kW or more may be provided to the tractor over the cable. In such a circumstance, voltage and current for the power delivery may be directed at the surface. However, the particular properties of the cable may determine the particular power delivery which actually reaches the downhole tractor. For example, the loop resistance over the length of the cable may be cumulative such that power delivery is significantly affected where over about 30,000 feet of cable is employed before a downhole tool such as the tractor is reached.

For a variety of reasons as noted above, the use of downhole cables exceeding 30,000 feet is generally considered impractical for hydrocarbon well applications. Whether a matter of load, telemetry, or power limitations, cables substantially exceeding 30,000 feet or so generally remain unavailable and impractical, thereby limiting the effective monitoring and operating of wells exceeding such depths.

SUMMARY

A cable assembly is provided for a hydrocarbon well application. The cable assembly includes an uphole cable portion coupled to a downhole cable portion. The uphole cable portion is of a greater break strength than said downhole cable portion.

A cable assembly is also provided for data transmission in a hydrocarbon well. The cable assembly includes an uphole cable portion and a downhole cable portion. A data transmission sub is also provided that is coupled to both of the cable portions. The sub is configured to amplify a signal between the downhole cable portion and the uphole cable portion.

DETAILED DESCRIPTION

Embodiments are described with reference to certain downhole applications of extensive or extreme depths which may employ embodiments of extended length cable assemblies. For example, diagnostic applications taking place at well depths exceeding 30,000 feet are described herein. However, hydrocarbon well applications employing embodiments of extended length cable assemblies as described herein may effectively proceed at shallower depths. Furthermore, applications aside from well diagnostics may utilize extended length cable assemblies as detailed herein. Regardless, embodiments described herein generally include cable portions of differing physical character from one another depending on the well depths to be occupied by the different portions. Additionally, the term "depth" is used herein to generally describe the distance from the surface of an oilfield to a downhole location in a well. This may include vertical depth in a conventional sense, as well as distances through non-vertical portions of the well.

Figure 1:
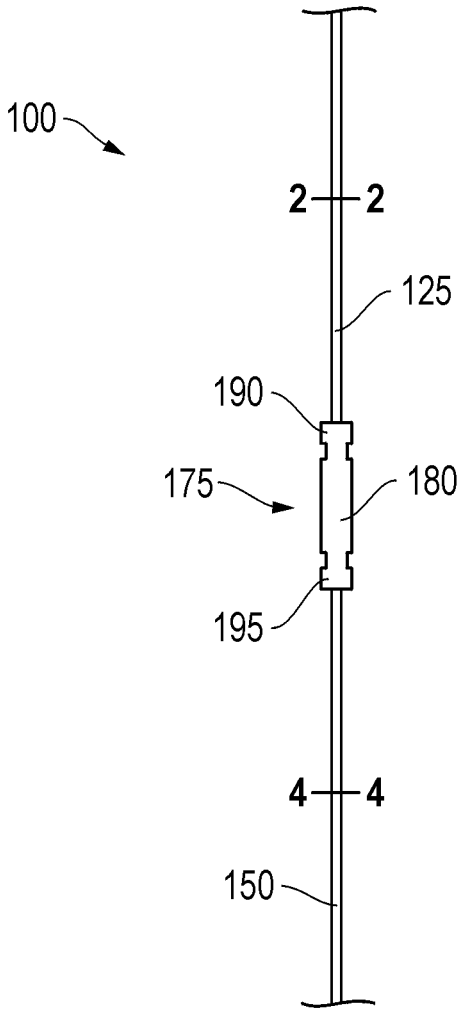
FIG. 1 is a side view of an embodiment of an extended length cable assembly.

Referring now to FIG. 1, an embodiment of a cable assembly 100 is shown. The assembly 100 may have of an extended length of between about 30,000 feet and about 50,000 feet or more as measured from one end of an uphole cable portion 125 to the opposite end of a downhole cable portion 150. In the embodiment shown, the cable portions 125, 150 are joined together through an intervening connector sub 175. The sub 175 may be of stainless steel or other suitable material for downhole use. As detailed below, the connector sub 175 is a subassembly having uphole 190 and downhole 195 receiving portions for accommodating terminal ends of the cable portions 125, 150 therein. Additionally, a central housing 180 is provided wherein interior data transmission features the separate cable portions 125, 150 may be communicatively spliced together. Those skilled in the art will appreciate that more than two cable portions, such as the cable portions 125, 150, and more than one connector sub 175 may be utilized to form the cable assembly 100.

The uphole cable portion 125 of the assembly 100 of FIG. 1 may be of substantially different physical character than the downhole cable portion 150. For example, in comparison to one another, the uphole cable portion 125 may be of substantially greater break strength whereas the downhole cable portion 150 may be substantially lighter per foot. Along these lines, in an embodiment the uphole cable portion 125 is more than about twice the break strength of the downhole cable portion 150, for example, with about 32,000 lbf versus only about 15,000 lbf of the downhole cable portion 150. Similarly, the downhole cable portion 150 may be of a substantially higher temperature rating and overall durability.

As described in greater detail below, the differences in physical character between the cable portions 125, 150 may be achieved through the use of an overall smaller diameter downhole cable portion 150. Additionally, the downhole cable portion 150 may include less interior support structure or lower strength-to-weight ratio interior support structure.

Figure 5A:
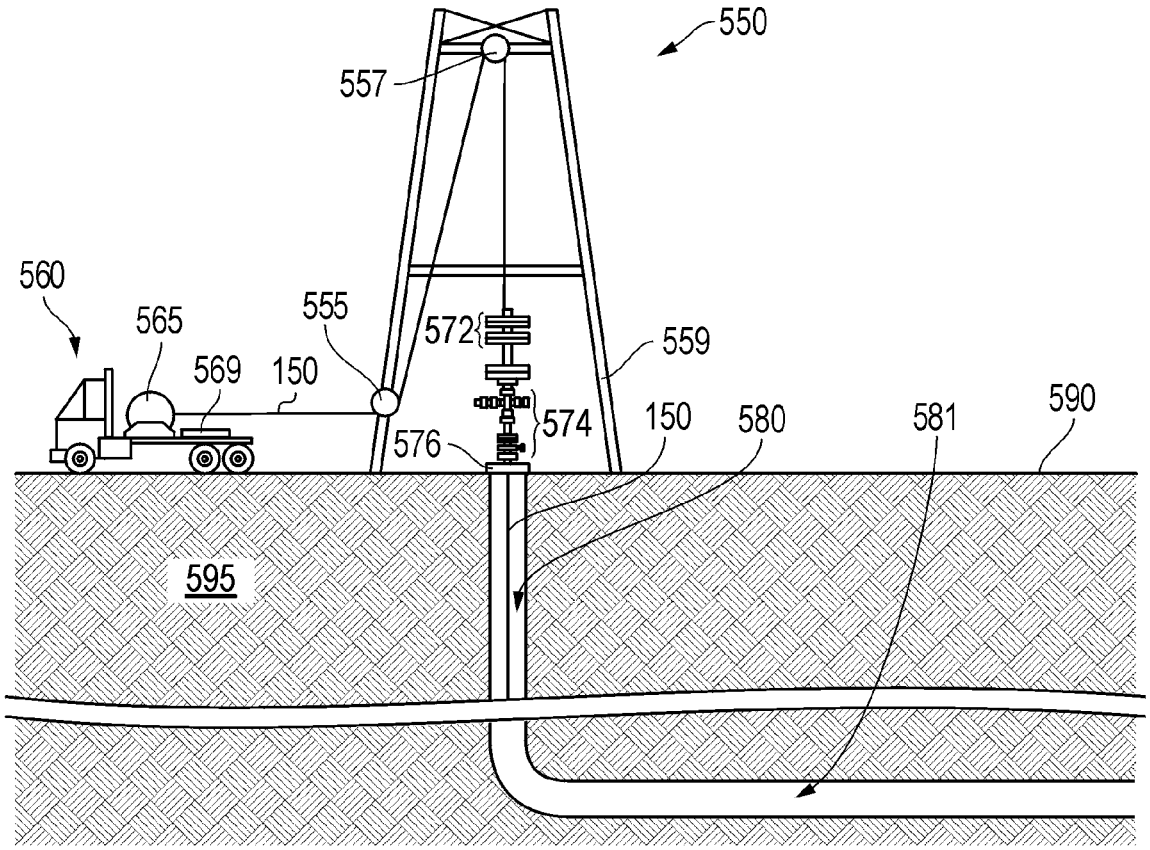
FIG. 5A is a side overview of an oilfield with a well thereof accommodating deployment of the downhole cable portion of FIG. 4.
Figure 5B:
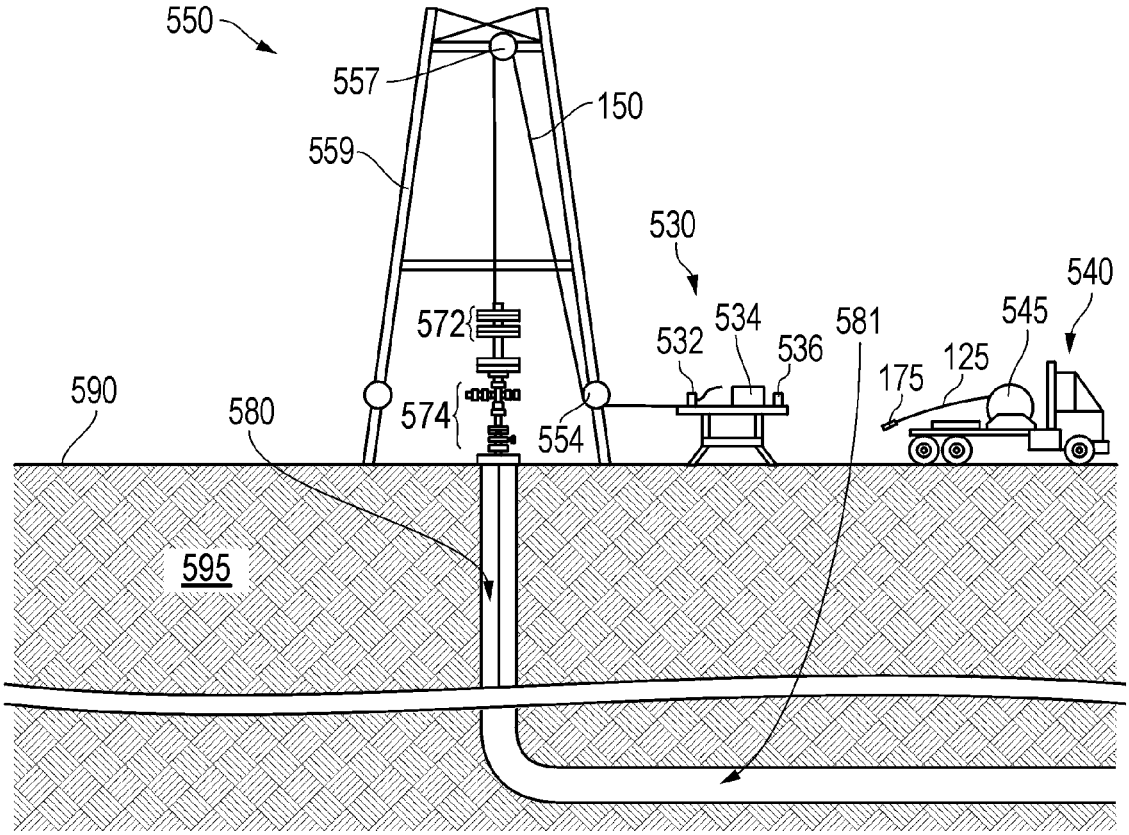
FIG. 5B is a side overview of the oilfield of FIG. 5A accommodating the uphole cable portion and connector sub of FIGS. 2 and 3.
Figure 5C:
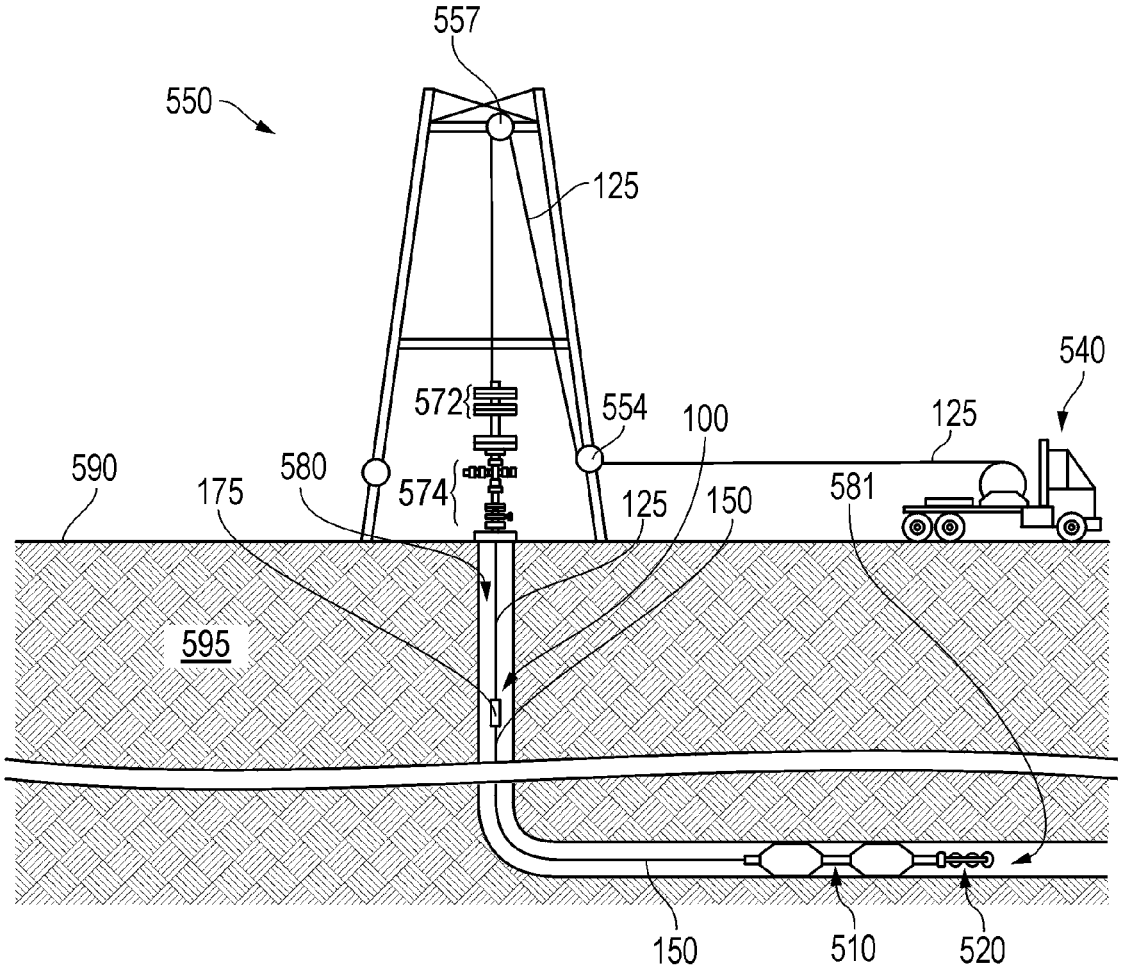
FIG. 5C is a side overview of the oilfield of FIG. 5B with the well thereof accommodating the extended length cable assembly of FIG. 1.

By employing a lighter and/or substantially lower strength-to-weight ratio for the downhole cable portion 150, the load placed on the uphole cable portion 125 during positioning of the assembly 100 in a well 580 is reduced (see FIG. 5C). So for example, the lighter downhole cable portion 150 may be 20,000 feet or more in length. As such, the complete assembly 100 may be deployed into a well 580 to depths exceeding 30,000 feet without significant structural deterioration taking place at the stronger uphole cable portion 125 where the load is generally the greatest.

Figure 2:
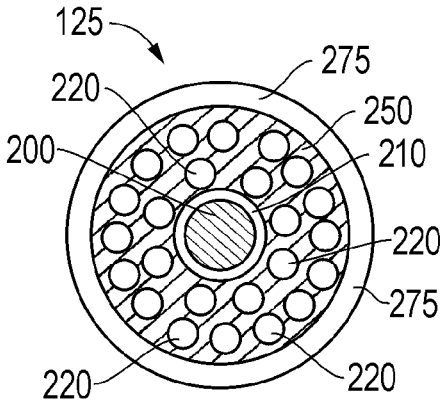
FIG. 2 is a cross-sectional view of an embodiment of an uphole cable portion of the extended length cable assembly taken from 2-2 of FIG. 1.

Continuing now with reference to FIG. 2, a cross-section of the higher strength uphole cable portion 125 is shown. The uphole cable portion 125 may be of a variety of configurations tailored to accommodate greater amounts of load. For example, in the particular embodiment shown, the interior support structure of the uphole cable portion includes a host of structural caged armor windings 220 surrounding a coaxial conductive core 200. In an embodiment the windings 220 may be of steel-based, such as stainless steel, or of other suitable high-strength material. In this manner, the load of the entire deployed assembly 100 may be sufficiently accommodated by the uphole cable portion 125 from the surface of an oilfield 590 without concern over load damage thereto (see FIG. 5C). Indeed, as indicated above, the load of the entire assembly 100 is lessened by the use of the lower weight downhole cable portion 150, thereby further increasing the capability of the uphole cable portion 125 to support itself and the rest of the assembly 100.

Continuing with reference to FIG. 2, the conductive core 200 may be of copper or other suitable metal which is isolated by an insulating polymer 210 to help maximize the communicative capacity thereof Additionally, the windings 220 may be surrounded by a carbon fiber matrix 250 and the entire uphole cable portion 125 covered by a jacket 275 of stainless steel or other high strength material suitable for a downhole environment.

Figure 3:
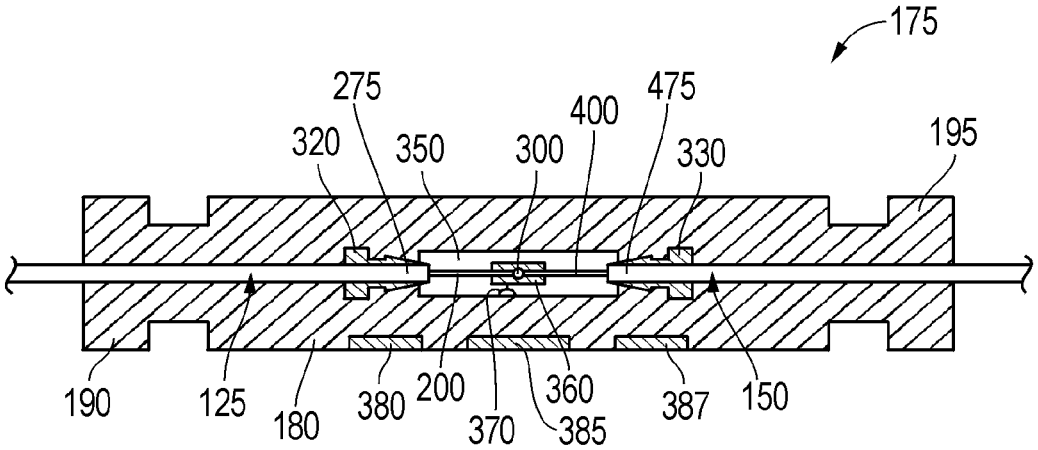
FIG. 3 is a side cross-sectional view of an embodiment of a connector sub of the extended length cable assembly of FIG. 1.

Referring now to FIG. 3, a side cross-sectional view of the connector sub 175 is shown. As depicted, the uphole cable portion 125 is accommodated within an uphole receiving portion 190 of the sub 175 and secured by an uphole retention mechanism 320 within the central housing 180 of the sub 175. Similarly, the lighter weight downhole cable portion 150 is accommodated within a downhole receiving portion 195 of the sub 175 and secured by a downhole retention mechanism 330 within the central housing 180. The retention mechanisms 320, 330 may be conventional clamping devices sufficient to physically accommodate any load uphole or downhole thereof which may be imparted on the uphole 125 or downhole 150 cable portions.

In addition to physical support, the housing 180 of the sub 175 includes a chamber 350 where the above noted conductive core 200 may be coupled to a conductive core 400 of the downhole cable portion 150. That is, as detailed further below, jackets 275, 475 and other outer portions of the cable portions 125, 150 may be cut back and the conductive cores 200, 400 spliced to one another. As depicted in FIG. 3, a communicative coupling 300 of the cores 200, 400 may be formed which is covered by a protective casing 360.

In an embodiment, the communicative coupling 300 and/or a core 200, 400 is routed through a conventional impedance matching transformer of the sub 175 so as to compensate for any significant gauge difference between the cores 200, 400. Similarly, the coupling 300 may be achieved through a signal refinement mechanism including conventional filters. Furthermore, separate electronics packaging 380, 385, 387 may be imbedded within the housing 180 and electronically coupled to the cores 200, 400 and/or the coupling 300 through conventional wiring 370.

With added reference to FIGS. 1 and 5C, the above noted packaging may include a signal amplification mechanism 380 for amplifying the transmission of data between the cores 200, 400. This may be of unique benefit for the transmission of data from the downhole cable portion 150, where return signals may be particularly weak, to the uphole cable portion 275. For example, with an extended length cable assembly 100 exceeding 30,000 feet, the signal path running from one end of the assembly 100 to the other and back will be in excess of at least 60,000 feet. Thus, with a conventional telemetry loss over the cores 200, 400 of about 1 dB per thousand feet, the return signal would be unlikely detectable back at surface without amplification. As such, the signal amplification mechanism 380 is provided to ensure adequate return data transmission from the downhole cable portion 150 to the uphole cable portion 275. Indeed, the mechanism 380 may also be employed to initially amplify signal from the uphole cable portion 275 to the downhole cable portion 150 as well. Overall, the inclusion of a signal amplification mechanism 380 as described may effectively reduce dB loss to less than about 0.5 dB per thousand feet, thereby at least doubling the telemetry and useful length of the assembly 100. Along these same lines, the mechanism 380 may also incorporate a telemetry repeater.

Other packaging may include a power regulating mechanism 385 to tailor voltage and current supplied from surface equipment at the oilfield 590 to match the power needs of downhole equipment 510, 520 coupled to the assembly 100. For example, in an embodiment, the power regulating mechanism 385 may be employed to step down voltage and current directed from the surface so as to avoid overloading the downhole equipment 510, 520. In this manner, high voltage and current may be supplied from the surface in light of the extreme depths of the assembly 100 without concern over unintentionally overloading the equipment 510, 520, for example, in advance of reaching more extreme depths in the well 580. Additionally, a sensor mechanism 387 may be incorporated into the housing 180 and communicatively coupled to the cores 200, 400 and/or coupling 300 so as to provide information regarding conditions at the connector sub 175. For example, pressure, temperature, and load information may be provided in this manner.

Figure 4:
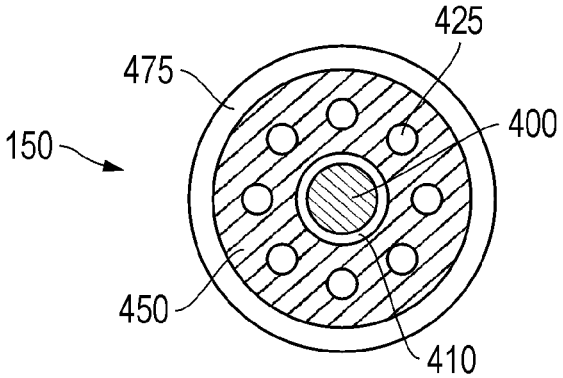
FIG. 4 is a cross-sectional view of an embodiment of a downhole cable portion of the extended length cable assembly taken from 4-4 of FIG. 1.

With particular reference to FIG. 4 and added reference to FIG. 2, the downhole cable portion 150 is of a lighter weight, lower break strength configuration. As indicated, this lessens the load on the uphole cable portion 125. As visible in the cross-section of FIG. 4, the lighter nature of this portion 150 may be due in part to a substantial reduction in the number of structural caged armor windings 425 as compared to those of the uphole cable portion 125. For example, in an embodiment, at least about 30% fewer windings 425 are employed in the downhole cable portion 150 as compared to the uphole cable portion 125. Considering that the downhole cable portion 150 may be anywhere from 10,000 to 30,000 feet or more, this reduction in the number of windings 425 may dramatically reduce the overall load on the uphole cable portion 125.

Additionally, in an embodiment, the windings 425 of the downhole cable portion 150 may constructed with a smaller amount of steel or of a lighter weight material per foot altogether. For example, in an embodiment the windings 425 of this portion 150 are of titanium, a titanium alloy, or aluminum. These particular windings 425 may be coated with a thin layer of polymer during manufacture to avoid galling when incorporated into the downhole cable portion 150. In another embodiment, the windings 425 may include separate strands of steel and titanium, or similar light weight material, wound about one another.

With particular reference to FIG. 4, the conductive core 400 may again be of copper of other suitable material, generally matching that of the core 200 of the uphole cable portion 125 of FIG. 2. An insulating polymer 410 is shown about the core 400 to help maximize the communicative capacity thereof Additionally, the windings 425 may be surrounded by a carbon fiber matrix 450 and the entire downhole cable portion 150 covered by a jacket 475 of stainless steel or other high strength material suitable for a downhole environment.

Referring now to FIGS. 5A-5C, techniques for deploying an extended length cable assembly 100 as depicted in FIG. 1 are detailed with reference to an overview of an oilfield 590 with a hydrocarbon well 580 of extended depth provided for accommodating the assembly 100. More specifically, FIG. 5A depicts the initial deployment of a downhole cable portion 150 into a well 580 from a first cable truck 560. Downhole equipment 510, 520 is disposed at the end of this cable portion 150 and becomes visible in FIG. 5C upon entering a lateral leg 581 of the well 580. FIG. 5B depicts the uphole cable portion 150 secured to a splicing table 530 adjacent a second cable truck 540. The second cable truck 540 accommodates an uphole cable portion 125 with the connector sub 175 secured thereto. FIG. 5C, thus reveals the fully assembled cable assembly 100. The assembly 100 is disposed within the extended depth well 580 to the point that the downhole equipment 510, 520 is now visible within a lateral leg 581 thereof, potentially 30,000-50,000 feet below the surface of the oilfield 590 or more. Nevertheless, the structural integrity and telemetric capability of the assembly 100 remain effective for applications to be performed by the equipment 510, 520 in the lateral leg 581.

With particular reference to FIG. 5A, an oilfield 590 is depicted with a rig 550 for receiving a downhole cable portion 150 as detailed above from a first cable truck 560 as noted above. The truck 560 accommodates a cable reel 565 and control unit 569 for directing the delivery of the downhole cable portion 150 as shown. Thus, a mobile, operator-friendly, manner of delivering the cable portion 150 as shown is provided. The rig 550 is equipped with upper 557 and lower 555 sheaves for guiding the cable portion 150 into a well 580 running through a formation 595 at the oilfield 590. In particular, the cable portion 150 is guided through a blow out preventor stack 572 and master control valve 574 on its way through the well head 576.

The well 580 itself runs through a formation 595 at the oilfield 590 in an effort to retrieve hydrocarbons therefrom. The well 580 may be of an extended depth, exceeding between about 30,000 and about 50,000 feet. In the embodiment shown, a lateral leg 581 of the well 580 contributes to its overall depth. Regardless, the downhole cable portion 150 is configured in such a manner so as to allow the assembly 100 of FIG. 5C to be effective for applications at such depths as described further below with reference to FIGS. 5B and 5C.

Continuing now with reference to FIG. 5B, the downhole cable portion 150 is shown strung over an opposite sheave 554 of the rig 550 and free of the first cable truck 560 of FIG. 5A. With added reference to FIG. 5A, this may be achieved by utilizing the blow out preventor stack 572 and master control valve 574 to close off the well 580 at the head 576 and stably secure the downhole cable portion 150 in place. Thus, the cable portion 150 may be restrung over the opposite sheave 554 as depicted in FIG. 5B. Indeed, the end of the cable portion 150 may be secured to a splicing table 530 at a first clamp 532 thereof.

As shown, the uphole cable portion may be provided to the oilfield 590 by way of a second mobile cable truck 540 with cable reel 545. The uphole cable portion 125 may be pulled from the reel 545 and, as with the downhole cable portion 150, secured to the splicing table 530, in this case at a second clamp 536 thereof. Thus, the connector sub 175 may be positioned at a support 534. As shown, the sub 175 and uphole cable portion 125 are provided in a pre-coupled manner. Additionally, with the sub 175 stabilized at the support 534 more precise coupling and splicing of the downhole cable portion 150 may now also be achieved as described above with reference to FIG. 3.

Continuing now with reference to FIG. 5C, the extended length cable assembly 100 is now fully assembled. As such, the blow out preventor stack 572 and master control valve 574 may be employed to re-open the well 580. Additionally, the sub 175 and uphole cable portion 125 are configured to allow the equipment 510, 520 of the assembly 100 to be advanced to the full depths of the well 580 without significant concern over effective telemetry through the assembly 100 or the structural integrity of the assembly 100, particularly at the uphole cable portion 125.

By way of example, a tractor 510 may be effectively employed to position a diagnostic tool 520 within a lateral leg 581 of a well 580 that may be in excess of 30,000-50,000 feet in depth, if not more. In the particular embodiment shown, the tractor 510 may operate at between about 1.5 to 2 kW with power optimized through the sub 175 in terms of voltage and current. However, alternative power parameters may be employed, not to mention a variety of different equipment tools and applications.

Figure 6:
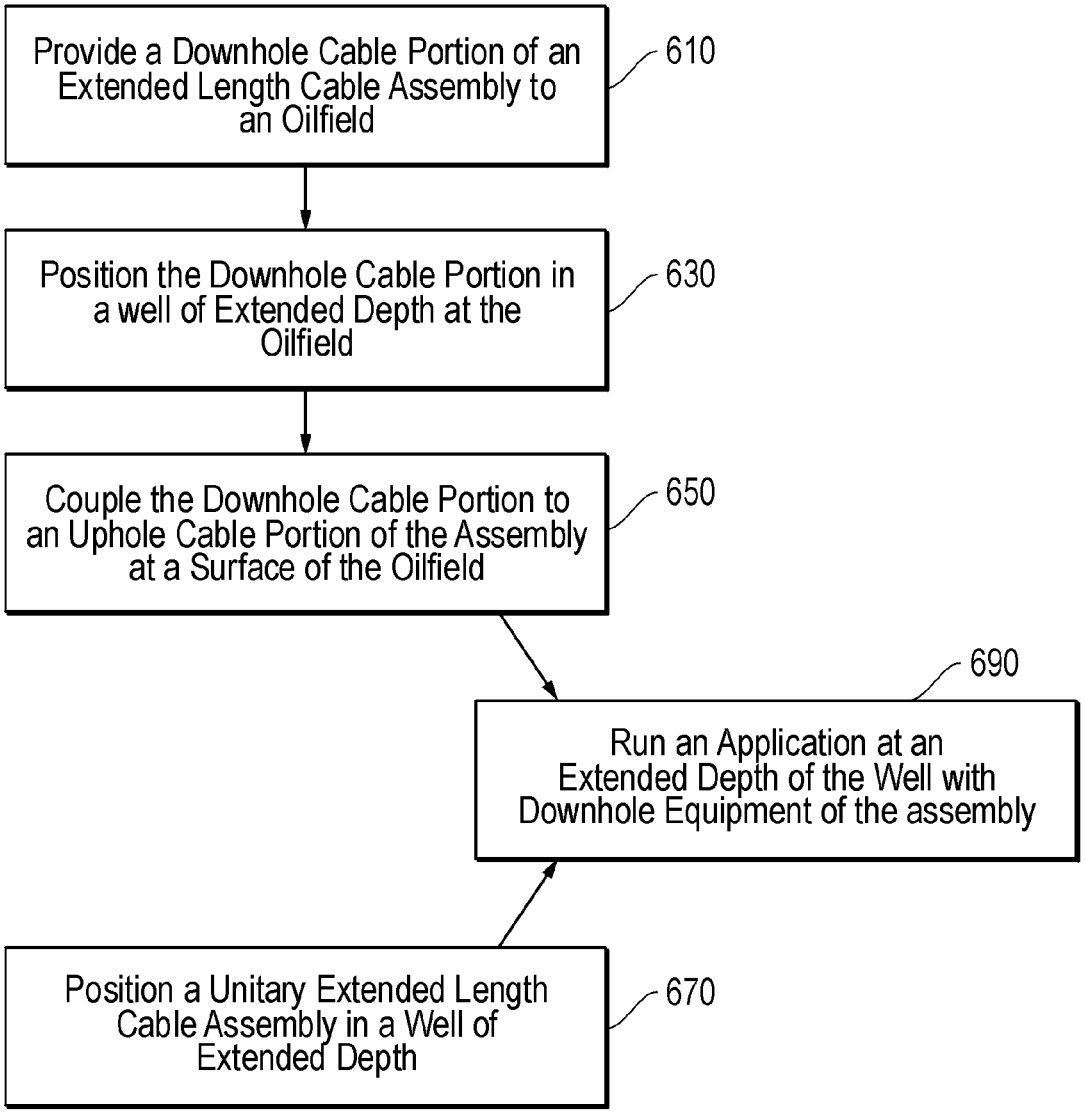
FIG. 6 is a flow-chart summarizing an embodiment of deploying an extended length cable assembly in a hydrocarbon well at an oilfield.

Referring now to FIG. 6, a flow-chart is depicted which summarizes an embodiment of employing an extended length cable assembly in a well of extended depth. Ultimately, as indicated at 690, an application may be run at an extended depth of the well with downhole equipment of the assembly. As indicated above, the extended depth of the well may be in excess of 30,000 or perhaps even 50,000 feet. Nevertheless, the application may proceed without undue concern over telemetry issues or compromise to the structural integrity of the assembly due to the amount of load involved.

The above telemetry and structural integrity concerns may be addressed by employing an extended length cable assembly having separate cable portions of different configurations. That is, as indicated at 610 and 620, a downhole cable portion may be provided to an oilfield and positioned within the well thereat. This downhole cable portion, of comparatively lighter construction, may then be coupled to an uphole cable portion to complete the assembly as indicated at 650. The steps 610, 630, and 650 may be repeated as required (i.e., when there are more than two cable portions and/or more than one connector sub) to complete the assembly, as will be appreciated by those skilled in the art. As detailed above, the uphole cable portion of the assembly may be of comparatively greater weight and break strength. This, in combination with the lighter character of the downhole cable portion may help to alleviate structural integrity concerns with regard to the load on the assembly. Additionally, the uphole and downhole cable portions may be coupled to one another through a connector sub which incorporates a signal amplification mechanism therein so as to maintain effective telemetry throughout the assembly.

Continuing with reference to FIG. 6, an alternative to the method described above is provided. Namely, the application as indicated at 690 may be achieved through use of a unitary extended length cable assembly as indicated at 670. That is, as opposed to providing the uphole and downhole cable portions separately to the oilfield, a single unitary assembly may be provided. Nevertheless, the unitary assembly may share much of the same character as detailed above. For example, a single assembly may be constructed that includes a common core running through an end of high break strength that gradually, over the course of tens of thousands of feet in length, becomes lighter. In such an embodiment, conventional co-extrusion and other manufacturing techniques along with variations in cable material choices may be employed in tapering down of the break strength over the length of the assembly from an uphole portion to a downhole portion thereof.

Embodiments of extended length cable assemblies detailed hereinabove include assemblies configured to support their own load and maintain structural integrity while disposed in wells to depths exceeding 30,000 feet. Indeed, such assemblies may maintain structural integrity while disposed to depths of over 50,000 feet while accommodating a host of downhole tools at the downhole end thereof. Additionally, telemetry concerns through such an assembly, for example between the surface and downhole equipment may be alleviated through the use of an intervening connector sub with a built-in signal amplification mechanism. Thus, conventional signal loss in dB/foot of cable assembly may be overcome. Furthermore, embodiments detailed herein may even avoid significant power control concerns over extensive cable lengths by the incorporation of a power regulating mechanism in the sub.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, alternative techniques may be utilized in positioning a completed extended length cable assembly in a well of extended depth. Such techniques may include use of a dual or split drum spooling system as opposed to separate mobile cable trucks as detailed above. Regardless, the foregoing description should not be read as pertaining only to the precise structures described and shown in the accompanying drawings, but rather should be read as consistent with and as support for the following claims, which are to have their fullest and fairest scope.

We claim:

1. A cable assembly, comprising:

at least one uphole cable portion for a hydrocarbon well application; and at least one downhole cable portion for the hydrocarbon well application coupled to said at least one uphole cable portion, said uphole cable portion of substantially greater break strength than said downhole cable portion, wherein said at least one uphole cable portion comprises uphole structural windings and said at least one downhole cable portion comprises downhole structural windings and wherein said downhole structural windings number at least about 30% fewer than said uphole structural windings.

2. The cable assembly of claim 1 wherein the break strength of said at least one uphole cable portion is more than about twice that of the at least one downhole cable portion.

3. The cable assembly of claim 1 being in excess of about 30,000 feet.

4. The cable assembly of claim 1 being in excess of about 50,000 feet.

5. The cable assembly of claim 1 wherein said at least one downhole cable portion is of a substantially higher temperature rating than said at least one uphole cable portion.

6. The cable assembly of claim 1 wherein said at least one uphole cable portion is coupled to said at least one downhole cable portion through a connector sub, a communicative core of said at least one uphole cable portion coupled to a communicative core of said at least one downhole cable portion within said connector sub.

7. The cable assembly of claim 1 wherein said at least one downhole cable portion is one of substantially lighter per foot than said at least one uphole cable portion and substantially lower strength-to-weight ratio than said at least one uphole cable portion.

8. The cable assembly of claim 1 wherein said uphole structural windings are substantially greater in number than said downhole structural windings.

9. The cable assembly of claim 1 wherein said downhole structural windings are substantially lighter per foot than said uphole structural windings.

10. The cable assembly of claim 9 wherein said uphole structural windings are steel-based and said downhole structural windings include a material selected from a group consisting of titanium, a titanium alloy, and aluminum.

11. A cable assembly for data transmission in a hydrocarbon well, the assembly comprising:

an uphole cable portion;

a data transmission sub coupled to said uphole cable portion; and a downhole cable portion coupled to said data transmission sub, said data transmission sub configured for amplifying a signal between the downhole cable portion and the uphole cable portion, the downhole cable portion of substantially different physical character and substantially less break strength than said uphole cable portion, wherein said uphole cable portion comprises uphole structural windings and said downhole cable portion comprises downhole structural windings and wherein said downhole structural windings number at least about 30% fewer than said uphole structural windings.

12. The cable assembly of claim 11 wherein said data transmission sub comprises a signal amplification mechanism for the amplifying, said data transmission sub further comprising one of an impedance matching transformer, a signal refinement mechanism, a telemetry repeater, a power regulating mechanism, and a sensor mechanism.

13. The cable assembly of claim 12 wherein said signal amplification mechanism is configured to limit dB loss to less than about 0.5 dB per foot of the cable assembly during data transmission.

14. The cable assembly of claim 12 wherein said sensor mechanism is configured to monitor one of pressure, temperature, and load.

15. A cable assembly for disposing in a hydrocarbon well to a depth exceeding about 30,000 feet, the cable assembly comprising an uphole portion coupled to a downhole portion of substantially different physical character than said uphole portion, wherein said uphole cable portion comprises uphole structural windings and said downhole cable portion comprises downhole structural windings and wherein said downhole structural windings number at least about 30% fewer than said uphole structural windings.

16. The cable assembly of claim 15 wherein said uphole portion and said downhole portion comprise a unitary configuration.

17. The cable assembly of claim 15 wherein the substantially different physical character includes said uphole portion being one of a substantially greater break strength than said downhole portion and a substantially lower temperature rating than said downhole portion.

18. The cable assembly of claim 15 wherein the substantially different physical character includes said downhole portion being one of substantially lighter per foot than said uphole portion and of a substantially lower strength-to-weight ratio than said uphole portion.

19. A method of employing a cable assembly in a hydrocarbon well, the method comprising:

positioning a portion of the cable assembly to a depth in the well exceeding about 30,000 feet, wherein positioning comprises delivering a downhole cable portion within the well;

coupling, at a surface of the hydrocarbon well, the downhole cable portion to an uphole cable portion of substantially greater break strength, wherein said uphole cable portion comprises uphole structural windings and said downhole cable portion comprises downhole structural windings and wherein said downhole structural windings number at least about 30% fewer than said uphole structural windings; and advancing the downhole cable portion to the depth; and running a well application with downhole equipment coupled to the portion.

20. The method of claim 19 wherein the downhole equipment comprises one of a downhole tractor, an intervention tool and a diagnostic tool.

21. The method of claim 19 wherein the cable assembly is of a unitary configuration.

22. The method of claim 19 wherein running comprises running a logging.

23. The cable assembly of claim 1 wherein said uphole and downhole cable portions each comprise:

a conductive core;

an insulating layer positioned about the conductive core;

a carbon fiber matrix positioned about the insulating layer and comprising a plurality of structural caged armor windings each embedded within the carbon fiber matrix; and a jacket covering the carbon fiber matrix.

* * * * *